US009414705B2

(12) United States Patent
Sclafani

(10) Patent No.: US 9,414,705 B2
(45) Date of Patent: Aug. 16, 2016

(54) CLOTHING MANAGEMENT APPARATUS

(71) Applicant: Stephanie Ann Sclafani, Kinnelon, NJ (US)

(72) Inventor: Stephanie Ann Sclafani, Kinnelon, NJ (US)

( * ) Notice: Subject to any disclaimer, the term of this patent is extended or adjusted under 35 U.S.C. 154(b) by 0 days.

(21) Appl. No.: 14/810,691

(22) Filed: Jul. 28, 2015

(65) Prior Publication Data

US 2016/0022078 A1 Jan. 28, 2016

Related U.S. Application Data

(60) Provisional application No. 62/029,719, filed on Jul. 28, 2014.

(51) Int. Cl.

| | |
|---|---|
| ***A47G 25/90*** | (2006.01) |
| ***A41F 9/00*** | (2006.01) |
| ***A41F 11/16*** | (2006.01) |
| *A41F 3/02* | (2006.01) |

(52) U.S. Cl.

CPC ..... *A47G 25/90* (2013.01); *A41F 9/002* (2013.01); *A41F 11/16* (2013.01); *A41D 2400/44* (2013.01); *A41F 3/02* (2013.01)

(58) Field of Classification Search

CPC ..... A41F 11/16; A41F 9/002; A41F 11/02; A41F 3/00

USPC ..... 2/311–315, 319, 303, 304, 326, 300, 2/229, 340

See application file for complete search history.

(56) References Cited

U.S. PATENT DOCUMENTS

| | | | | | |
|---|---|---|---|---|---|
| 2,567,277 | A * | 9/1951 | Farquhar | A41F 11/02 | 2/312 |
| 3,932,897 | A * | 1/1976 | Young | A41F 11/00 | 2/306 |
| 4,602,627 | A * | 7/1986 | Vito | A61F 5/0102 | 602/23 |
| 4,888,830 | A * | 12/1989 | Putnam | A41F 3/02 | 2/327 |
| 5,012,802 | A * | 5/1991 | Bischoff | A63B 71/1216 | 602/73 |
| 5,214,806 | A * | 6/1993 | Flores | A41F 5/00 | 2/300 |
| 6,308,338 | B1 * | 10/2001 | Caldwell | A41D 1/062 | 2/312 |
| 6,698,031 | B2 * | 3/2004 | Lewis | A41D 13/00 | 2/340 |

* cited by examiner

*Primary Examiner* — Tejash Patel

(74) *Attorney, Agent, or Firm* — Dunlap Bennett & Ludwig PLLC

(57) ABSTRACT

A clothing management apparatus is provided. The clothing management apparatus may include a waistband and a plurality of garment straps extending from the waistband to at least one lower garment, thereby making the at least one lower garment retrievable even while in a seated position. Each garment strap may provide adjustable, removable garment fasteners dimensioned and adapted to adjust the overall length of each garment strap.

13 Claims, 2 Drawing Sheets

CLOTHING MANAGEMENT APPARATUS

CROSS-REFERENCE TO RELATED APPLICATION

This application claims the benefit of priority of U.S. provisional application No. 62/029,719, filed Jul. 28, 2014, the contents of which are herein incorporated by reference.

BACKGROUND OF THE INVENTION

The present invention relates to garment accessories and, more particularly, an apparatus providing discrete clothing management for a user with balance deficits, lacking full hip/bending motion or the like.

Some individuals have balance deficits, hip precautions, lack full hip/bending motion or the like, forcing them to maintain a 90 degree or less bend at their hip joints at all times, or otherwise limit their bending motion. For such individuals, pulling up their lower garments, even from a seated position, can be impossible without assistance.

Besides getting the help of another individual, current apparatuses that address these limitations are hand-held or otherwise must be carried separately. Being hand-held, such apparatuses have the following disadvantages: cumbersome, making it more difficult to balance (for people already having a balance deficit); second, can be dropped, which would frustrate their very purpose of avoiding bending over unnecessarily; and third, are indiscreet, garnering usually unwanted attention or pity.

As can be seen, there is a need for a hands-free apparatus that is discretely worn about the waist so as to facilitate the clothing management of a user with balance deficits, lacking full hip/bending motion or the like.

SUMMARY OF THE INVENTION

In one aspect of the present invention, a clothing management apparatus includes a waistband having a first side and an opposing second side; a plurality of garment straps, each garment strap connected to the waistband and extending to a garment end; a pair of hook-and-loop halves disposed near each waistband end; and at least one fastener disposed near each garment end.

In another aspect of the present invention, a clothing management apparatus includes a waistband having a first side and an opposing second side, wherein the waistband extends from a left end to a right end; a complementary fastener along the left and right ends; a comfortable liner disposed along the second side; two strap loops formed along the first side; two under-garment straps extending from an under-waistband end to an under-garment end, wherein each under-waistband end is connected to different strap loops; two over-garment straps extending from a over-waistband end to an over-garment end, wherein each over-waistband end is connected to different strap loops; a pair of hook-and-loop halves disposed near each waistband end and each under-garment end, wherein each pair of hook-and-loop halves are dimensioned and adapted for forming an end loop of varying lengths; and a clip fastener disposed near each over-garment end.

In yet another aspect of the present invention, a method of lifting lower garments to a waist of a user includes providing a clothing management apparatus having a waistband and two pairs of hook-and-loop halves, each pair of hook-and-loop halves interconnected to the waistband with lower garment straps, and wherein each pair of hook-and-loop halves are dimensioned and adapted for forming an end loop of varying lengths; cutting two loop portions into a lower garment; adjustably connecting each pair of hook-and-loop halves, forming end loops so as to securely engage each loop portion; and pulling on each lower garment strap to lift the lower garment by its loop portions.

These and other features, aspects and advantages of the present invention will become better understood with reference to the following drawings, description and claims.

DETAILED DESCRIPTION OF THE INVENTION

Figure 1:
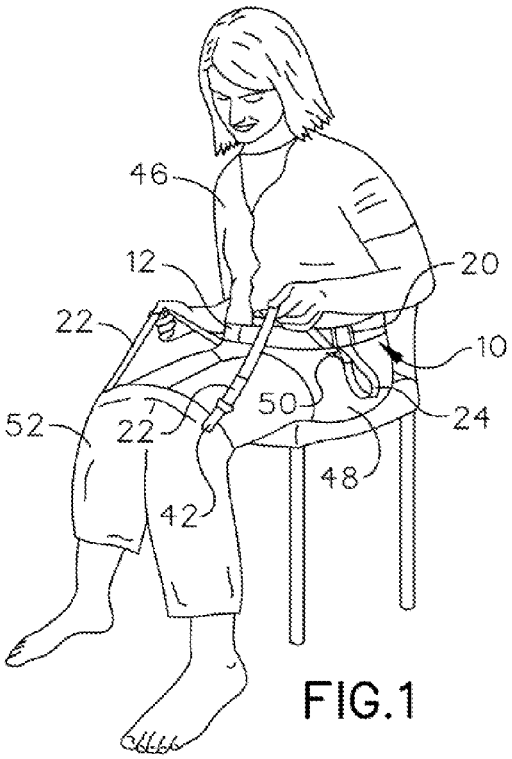
FIG. 1 is a perspective view of an exemplary embodiment of the present invention, shown in use.

The following detailed description is of the best currently contemplated modes of carrying out exemplary embodiments of the invention. The description is not to be taken in a limiting sense, but is made merely for the purpose of illustrating the general principles of the present invention.

Broadly, an embodiment of the present invention provides a clothing management apparatus. The clothing management apparatus may include a waistband and a plurality of garment straps extending from the waistband to at least one lower garment, thereby making the at least one lower garment retrievable even while in a seated position. Each garment strap may provide adjustable, removable garment fasteners dimensioned and adapted to adjust the overall length of each garment strap.

Referring now to FIGS. 1 through 4, the present invention may include a clothing management apparatus 10. The clothing management apparatus 10 may include a waistband 12 and a plurality of garment fasteners interconnected to the waistband 12 by a plurality of lower garment straps, including under-garment straps 24 and over-garment straps 22.

Figure 2:
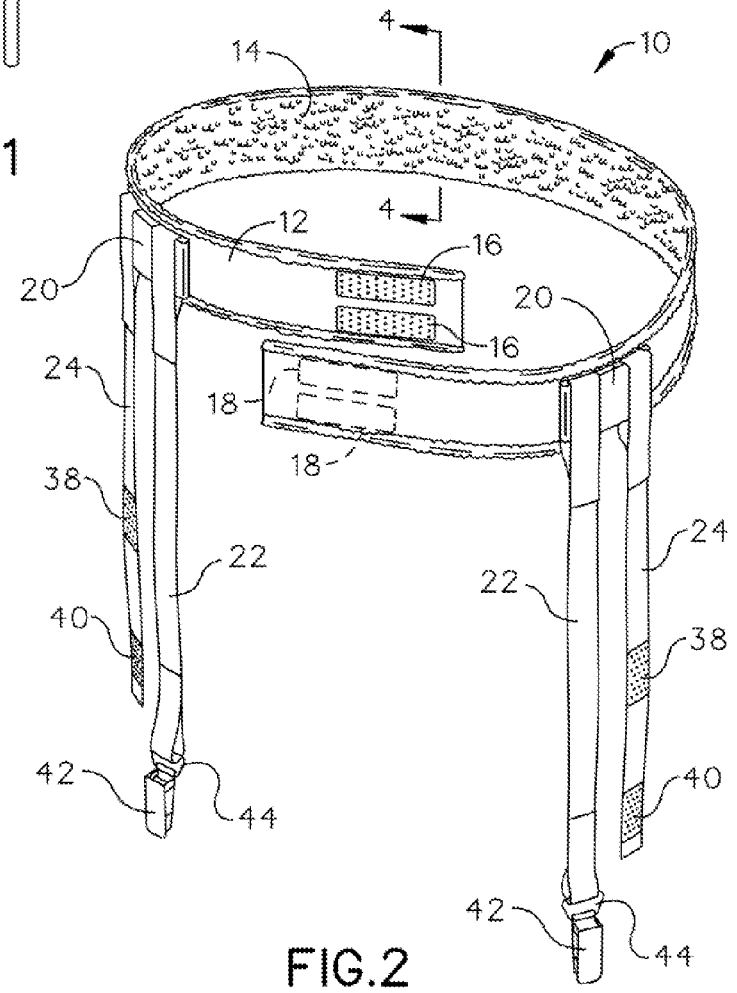
FIG. 2 is a perspective view of an exemplary embodiment of the present invention.

The waistband 12 may be made of resilient material dimensioned and adapted to wrap around a waist of a human wearer 46 for retaining the clothing management apparatus 10 and a plurality of lower garments. Lower garments may include but not be limited to under-garments 48, such as underwear, disposable underwear, adult diapers or the like, and over-garments 52, such as pants, skirts, shorts or the like, as illustrated in FIG. 1. The waistband 12 may include an inner lining 14 made of comfortable material, such as fleece, attached to the waistband 12 via stitching or an equivalent means. The waistband 12 may include at least one set of complementary fasteners 16, 18 disposed near opposing ends thereof for removably securing the waistband 12 about the human waist. The waistband 12 may form a plurality of strap loops 20 extending horizontally and sideways along the waistband 12, as illustrated in FIG. 2. Each strap loop 20 may be dimensions and adapted to slidably receive at least one end of a lower garment strap, such as under-garment straps 24 and/or over-garment straps 22. In certain embodiments, each strap loop 20 is dimensioned to accommodate at least two garment straps so that such straps are disposed along the waist of the user 46 at only two general locations, as illustrated in FIG. 2.

Each lower garment strap 24, 22 may extend from a waistband end to an opposing garment end. One of a plurality of complementary fasteners may be disposed near each end. The plurality of complementary fasteners may be any fastener known in the art for fastening or removably securing one object to another including, for example, standard push-button snaps, Velcro-type fasteners, adhesive substances, clips and rings, combinations thereof, and the like. It should also be that the plurality of complementary fasteners may be configured in any array and/or number, so long as the complementary fasteners function in accordance with the present invention as described herein.

Figure 3:
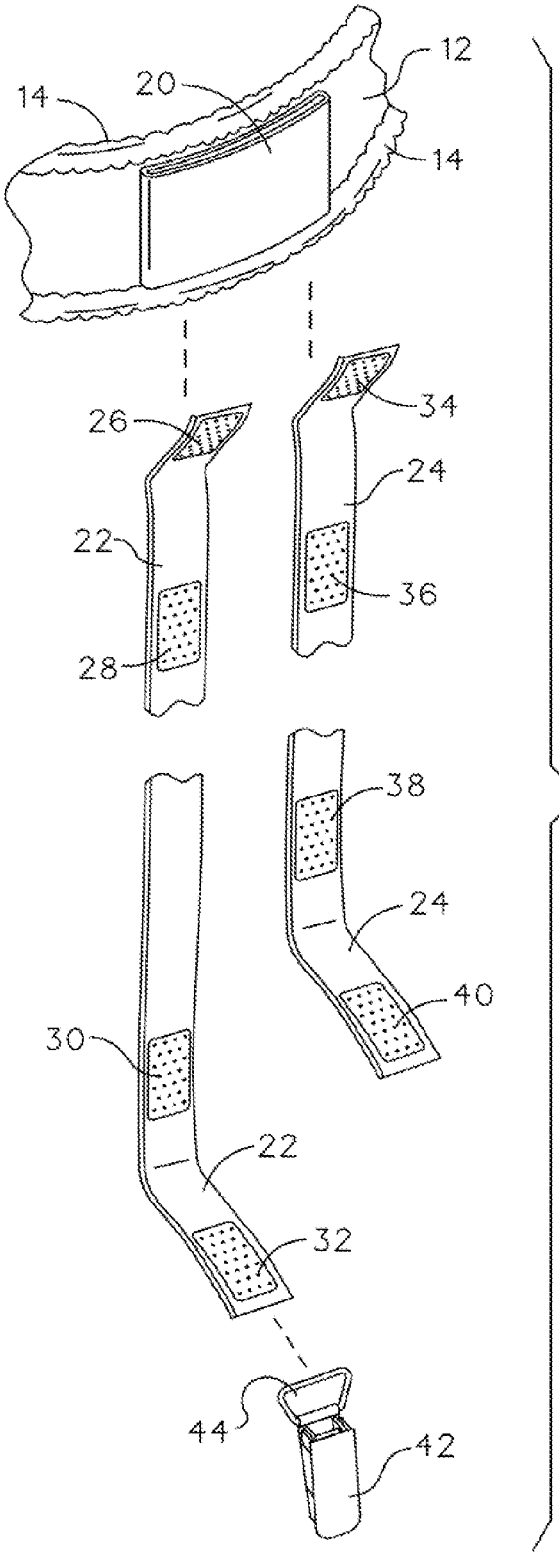
FIG. 3 is a detailed exploded view of an exemplary embodiment of the present invention.
Figure 4:
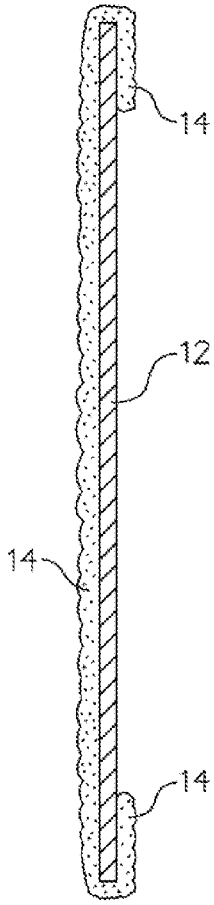
FIG. 4 is a detailed section view of an exemplary embodiment of the present invention, taken along line 4-4 in FIG. 2.

The plurality of complementary fasteners may provide both of two halves of a mating hook-and-loop combination 26, 28; 30, 32; 34, 36; and 38, 40, respectively. The hook portion 26, 28; 30, 32; 34, 36; and 38, 40 of the mating hook-and-loop combinations may be any known design and construction such as is commercially available under the trademark Velcro. Such combinations may be disposed near ends of a garment strap so as to form end loops for securely yet removably engaging the strap loop 20 of the waistband 12 or a loop portion 50 of a predetermined lower garment, as illustrated in FIG. 3. Such loop portions 50 may be manually cut into the predetermined lower garment with sufficient width to accommodate the formed end loop. Such combinations may enable end loop formations that are adjustable in their length and so enable the adjustability of the overall length of the resulting lower garment strap.

In an alternative embodiment, the end loops formed along a garment end may be adapted to removably secure a pant clip 42, possibly interconnected by an aperture ring 44. Each pant clip 42 may be adapted to removably secure to a lower garment of the user 46.

A method of using the present invention may include the following. The clothing management apparatus 10 disclosed above may be provided. The clothing management apparatus 10 may be worn discreetly under clothing allowing individuals independence in clothing management in a seated, squatting or standing position. For example, the under-garment straps 24 on each side of the waistband 12 may extend to attach each garment end to the under-garments 48. In certain embodiments, the associated hook-and-loop combination 38, 40 may be formed into a garment-end end loop of a predetermined length, thereby adjusting the overall length of said under-garment strap 24 for suitably securing the formed end loop through its associated loop portion 50. With such an engagement, the user 46 may pull on each under-garment strap 24 to raise the under-garments 48 while in a seated position, thereby making the unreachable within arm's reach, decreasing risk for loss of balance and/or breaking hip precautions, and therefore improving safety and increasing independence.

Similarly, the over-garment straps 22 may be attached to the pants 52 of the user 46, along the waistband thereof by the at least one pant clip 42, thereby enabling the lifting of said pants 52 in a seated or standing position, whereby the user 46 maintains at least a 90 degree or less bend at their hip joints.

It should be understood, of course, that the foregoing relates to exemplary embodiments of the invention and that modifications may be made without departing from the spirit and scope of the present invention.

What is claimed is:

1. A clothing management system, comprising:

a waistband adapted to extend around a waist of a wearer, extending from a free left end to a free right end, wherein the waistband comprises a strap loop disposed near each of the free left and free right ends;

a pair of garment straps, one of the pair of garment straps slidably connected to each of the two strap loops, and wherein each of the pair of garment straps comprises an undergarment strap and an over-garment strap independently slidably along the respective strap loop;

an undergarment interconnected to the waistband by each undergarment strap, enabling the undergarment to be retrievable when in a predetermined position beyond an arm's reach of the wearer; and an over-garment interconnected to the waistband by each over-garment strap, enabling the over-garment to be retrievable when in a predetermined position beyond the arm's reach of the wearer.

2. The clothing management apparatus of claim 1, wherein each garment strap extends from a strap loop end to a distal end, and wherein each strap loop end provides a first pair of spaced apart complementary removable fasteners.

3. The clothing management apparatus of claim 1, further comprising a liner disposed along an inner side of the waistband.

4. The clothing management apparatus of claim 2, wherein each distal end of each garment strap provides a second pair of spaced apart complementary removable fasteners.

5. The clothing management apparatus of claim 1, wherein the waistband further comprises a complementary waistband fastener along the free left and free right ends.

6. The clothing management apparatus of claim 4, a clip fastener selectively engaged by a loop formed along each distal end of each over-garment strap, wherein the loop is formed by the second pair of spaced apart complementary removable fasteners.

7. A method of lifting garments from a predetermined position beyond the arm's reach of a wearer, comprising:

providing a clothing management apparatus having a waistband extending from a free left end to a free right end, wherein the waistband comprises a strap loop disposed near each of the free left and free right ends; a pair of garment straps, one of the pair of garment straps slidably connected to each of the two strap loops, and wherein each of the pair of garment straps comprises an undergarment strap and an over-garment strap independently slidably along the respective strap loop;

extending and securing the free left and right ends around a waist of a wearer;

interconnecting an over-garment interconnected to the waistband by each over-garment strap; and pulling on each over-garment strap, thereby lifting the over-garment from a predetermined position beyond an arm's reach of the wearer to the arm's reach of the wearer.

8. A clothing management system, comprising:

waistband adapted to extend around a waist of a wearer, extending from a free left end to a free right end, wherein the waistband comprises a strap loop disposed near each of the free left and free right ends; and a pair of garment straps, one of the pair of garment straps slidably connected to each of the two strap loops, and wherein each of the pair of garment straps comprises an undergarment strap and an over-garment strap independently slidably along the respective strap loop.

9. The clothing management apparatus of claim 8, wherein each garment strap extends from a strap loop end to a distal end, and wherein each strap loop end provides a first pair of spaced apart complementary removable fasteners.

10. The clothing management apparatus of claim 8, further comprising a liner disposed along an inner side of the waistband.

11. The clothing management apparatus of claim 8, wherein each distal end of each garment strap provides a second pair of spaced apart complementary removable fasteners.

12. The clothing management apparatus of claim 8, wherein the waistband further comprises a complementary waistband fastener along the free left and free right ends.

13. The clothing management apparatus of claim 8, a clip fastener selectively engaged by a loop formed along each distal end of each over-garment strap, wherein the loop is formed by the second pair of spaced apart complementary removable fasteners.

* * * * *